United States Patent [19]

Benno et al.

[11] 3,959,949

[45] June 1, 1976

[54] SYSTEM, MACHINE AND METHOD FOR MULTIPACKAGING CONTAINERS

[75] Inventors: Edward Leonard Benno, Grayslake; David Frederick Schlueter; Lonnie Ray Seymour, both of Hoopeston, all of Ill.

[73] Assignee: Illinois Tool Works Inc., Chicago, Ill.

[22] Filed: June 2, 1975

[21] Appl. No.: 583,079

[52] U.S. Cl. ..... 53/35; 53/48

[51] Int. Cl.[2] ..... B65B 27/04; B65B 13/04

[58] Field of Search ..... 53/3, 35, 48, 196, 198 R; 29/208 B

[56] References Cited

UNITED STATES PATENTS

| | | | |
|---|---|---|---|
| 2,929,181 | 3/1960 | Poupitch | 53/35 |
| 3,032,943 | 5/1962 | Riemers et al. | 53/48 |
| 3,032,944 | 5/1962 | Hull et al. | 53/48 |
| 3,383,828 | 5/1968 | Cunningham | 53/35 |
| 3,628,305 | 12/1971 | Owen et al. | 53/35 |
| 3,742,677 | 7/1973 | Best | 53/26 |
| 3,775,935 | 12/1973 | Schlueter et al. | 53/48 |
| 3,816,968 | 6/1974 | Morgan et al. | 53/48 |

*Primary Examiner*—Robert L. Spruill
*Attorney, Agent, or Firm*—E. L. Benno; R. W. Beart

[57] ABSTRACT

A system for multipackaging at least three adjacent rows of containers with a resilient plastics-material multipackaging strip in a continuous procedure. The strip comprises a plurality of elongated bands of at least three in number transversely of the strip, and each band is capable of encircling one of the containers when properly stretched and projected over a container. The bands of the strip are so formed that stretching of all of the bands into shapes substantially complementary to the containers occurs when merely the side marginal edges of the strip are stretched apart. The machine and method comprises an endless series of single pairs of jaws or force applying means which successively enter the apertures of the side bands of the strip, and transversely stretch all of the bands across the strip into shapes substantially complementary to the container shapes. The machine receives at least three adjacent rows of containers continuously therethrough. As the containers are moving through the machine, the machine moves the jaws and the stretched strip carried thereon into cooperation with the containers to apply the bands of the strip about the containers to multipackage the containers.

9 Claims, 12 Drawing Figures

CAN FLOW
0°
60°
150°
215°
290°
315°
345°
A
B
C
D
E
F

SYSTEM, MACHINE AND METHOD FOR MULTIPACKAGING CONTAINERS

BACKGROUND OF THE INVENTION

Prior art machines for the continuous application of multipackaging strips to containers have generally been of the types shown in U.S. Pat. Nos. 3,383,828, 3,032,843, and 3,032,944. Those machines use pin or jaw elements which engage and individually stretch each of the bands of a multipackaging strip for application to a plurality of containers. Those prior art machines and their teachings have been limited to stretching and applying a strip of two rows of container encircling bands to two adjacent rows of containers, by mechanisms that positively engage and stretch the individual bands in the strip.

Something less than positive engagement and individual band stretching is taught in U.S. Pat. No. 3,742,677. In that patent a mechanism is shown that cuts a carrier strip into individual carrier devices and then grips each carrier device along its side marginal edges outside of the apertures of the carrier, stretches the carrier to effectively make it taut, and thereafter applies or projects it downwardly over the upper end of a group of six containers.

SUMMARY OF THE INVENTION

In contradistinction to the prior known multipackaging machines and methods for applying a strip of carrier devices to two adjacent rows of containers, the machine and method of the subject invention applies a strip of carrier devices to three, four or more adjacent rows of containers. The invention is unique in its radical departure from prior art teachings of positive engagement and stretching of individual carrier bands. In the subject invention, simple stretching forces or jaws are used merely within the bands along the sides of the appropriately formed strip to stretch those side bands and all other bands therebetween. Thus, the subject invention teaches those skilled in the art how to apply a multipackaging strip to three, four or more adjacent rows of containers. For example, the invention contemplates a machine and method that will apply a multipackaging strip to rows of containers that might be a full pallet in width, such as fifteen rows of adjacent containers. Further, the machine and method of the invention does not apply a strip by merely engaging the side marginal edges of a strip to effectively hold the strip taut, but operates to transversely stretch a narrow strip of elongated bands into shapes substantially complementary to the container shapes before applying the bands about the containers.

The machine and method of the invention cooperates with a certain multipackaging strip, which is the subject of the co-pending United States application of Mindaugas Julius Klygis, Ser. No. 581,591, filed May 29, 1975, to produce a unique system for the multipackaging of three or more adjacent rows of containers. The system contemplates the making of a multipackaging device from a strip of resilient plastics-material with an interconnected series of bands along each side of the strip, with at least one additional series of intermediate bands between the side bands, with the strip being substantially narrower than the width of the rows of containers to be multipackaged, with the bands being shaped so that opposed transversely applied stretching forces within the side bands causes all of the transversely aligned bands in the strip to stretch into shapes complementary to the shapes of the containers, with the moving of a number of rows of adjacent containers equal to the number of bands transversely of the multipackaging strip through a work station, with the successive application of opposed transversely applied stretching forces within the side or outboard bands of the strip, with the contemporaneous movement of the strip while being stretched toward the ends of the moving rows of containers in the work station until the stretched bands of the strip are applied about the containers, with a release of the strip thereafter, and with a transverse severance of the strip thereafter between selected longitudinally adjacent containers in the strip to form multipackages of the containers in selected multiples of the number of rows.

Other objects and features of the invention will be apparent upon a perusal of the hereinafter following specification read in conjunction with the drawings.

DETAILED DESCRIPTION OF THE PREFERRED EMBODIMENTS

Figure 2:
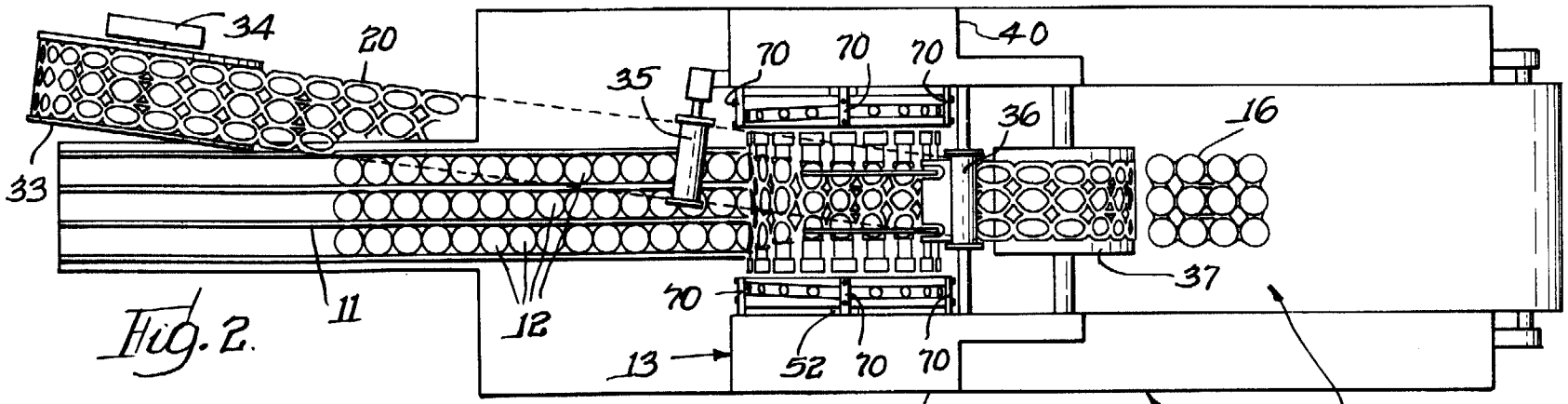
FIG. 2 is a top plan view of the machine of FIG. 1.
Figure 1:
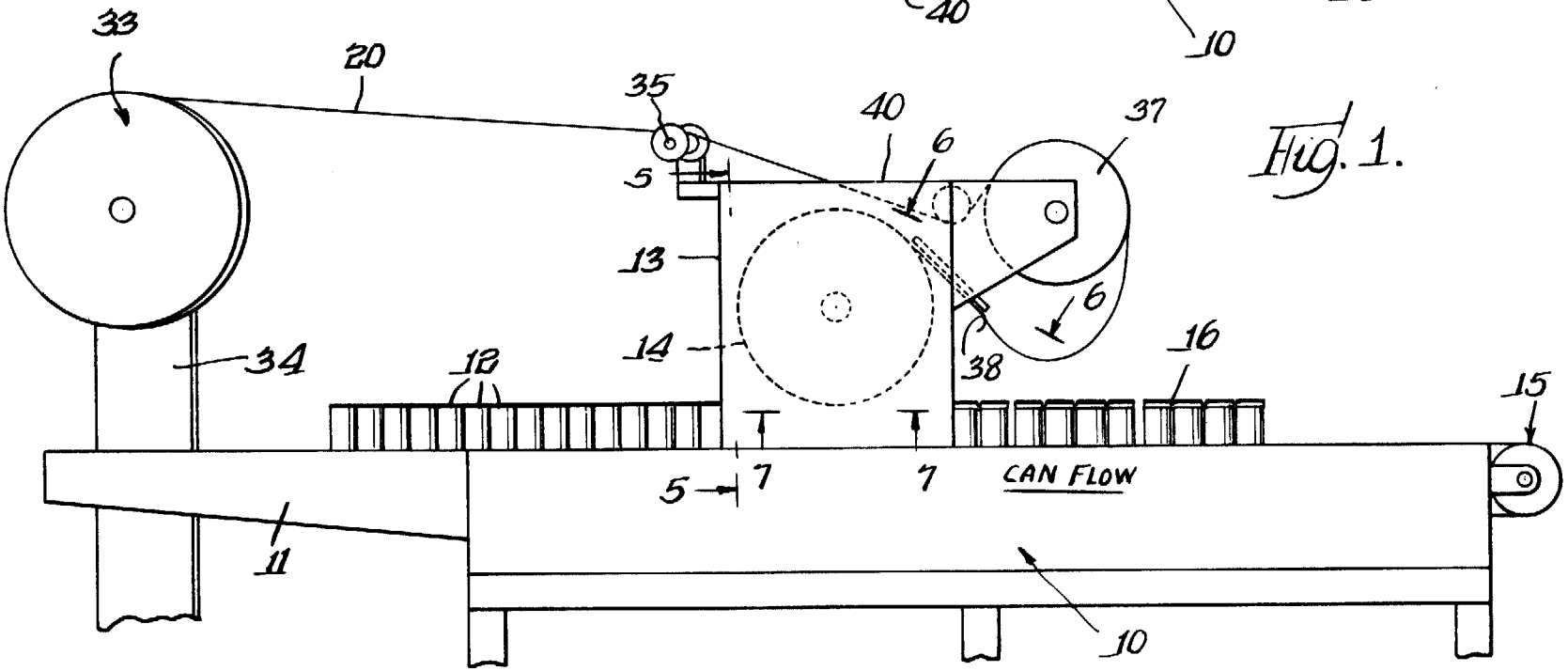
FIG. 1 is a side elevational view of a machine embodying the subject invention.

The total machine as shown in FIGS. 1 and 2 is substantially exemplary in form and many of the parts which are not critical to an understanding of the subject invention and for which known parts may be used are only briefly shown. The machine comprises a base 10 which may be constructed in any suitable known manner for supporting the operating elements of the machine. An input conveyor 11 of any suitable type is provided for delivering at least three adjacent rows of containers such as cans 12 to the work station 13 of the machine. Suitable known means may be provided in conjunction with the input conveyor 11 to move the rows of containers slightly spaced apart and in accurate ranks and files through the work station 13. The work station comprises a drum assembly 14 mounted therein immediately above the three rows of cans 12 passing through the work station 13. The drum assembly 14 is further carried to rotate about a horizontal axis transversely of the three rows of cans 12. The machine further includes a suitable output conveyor 15 for receiving multipacked containers, such as package 16, from the work station 13.

Figure 4:
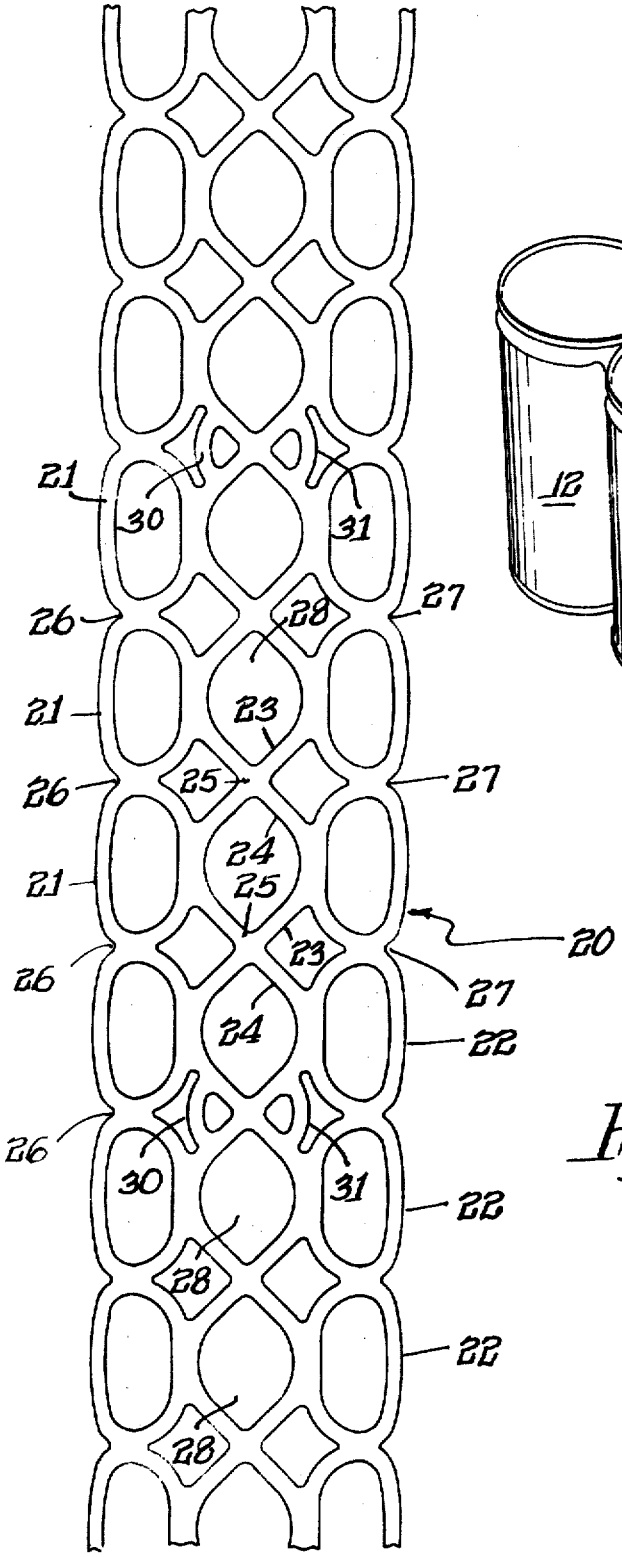
FIG. 4 is a plan view of a multipackaging strip that may be used in practicing the subject invention.

One form of multipackaging strip that can be applied to the cans 12 by the machine of the invention is shown in FIG. 4. That multipackaging strip, and other embodiments thereof, is shown and described in detail in the co-pending United States application of Mindaugas Julius Klygis, Ser. No. 581,591, filed May 29, 1975. The multipackaging strip 20 is made from a resilient plastic or plastics-material such as low density polyethylene. The strip 20 comprises an integrally interconnected row of elongated bands 21 along one side of the strip with another integrally interconnected row of elongated bands 22 along the other side of the strip 20. The bands 21 and 22 may be described as mirror images of each other. The strip 20 further comprises a plurality of substantially straight-line band segments 23 and 24. The straight-line band segments 23 and 24 intersect through integral intersecting areas 25. The straight-line band segments 23 and 24 are disposed diagonally of the longitudinal axis of the strip 20. The band segments 23 and 24 are further positioned between the bands 21 and 22 with the intersecting areas 25 being bisected by transverse lines drawn through the webs 26 between the bands 21 and the webs 27 between the bands 22. The ends of the band segments 23 and 24 are integrally interconnected to the inner band portions of the bands 21 and 22 as shown in FIG. 4. Each pair of straight-line band segments 23 and 24 in cooperation with the next longitudinally adjacent pair of straight-line band segments 23 and 24 defines an intermediate band transversely between the bands 21 and 22. The apertures 28 of the intermediate bands defined by the straight-line band segments 23 and 24 which may be described as generally lemon-shaped, are elongated in the longitudinal direction of the strip 20, and the periphery of each aperture 28 is circumferentially uninterrupted. The apertures of the bands 21 and 22 are also elongated in a direction longitudinally of the strip 20, and the inner periphery of the bands 21 and 22 are also circumferentially uninterrupted. The apertures 28 and the apertures of the bands 21 and 22 are substantially of the same maximum length, measured in a direction longitudinally of the strip 20. Further, the peripheral circumferential measurement of each aperture 28 is substantially equal to the inner peripheral dimension of each band 21 and 22. As described in the noted patent application of Mr. Klygis, a strip 20 configured as described can be stretched to produce aperture configurations approximately complementary to the circular shape of the cans 12 by opposed transverse stretching forces applied within the bands 21 and 22 and against the outer portions thereof.

Figure 3:
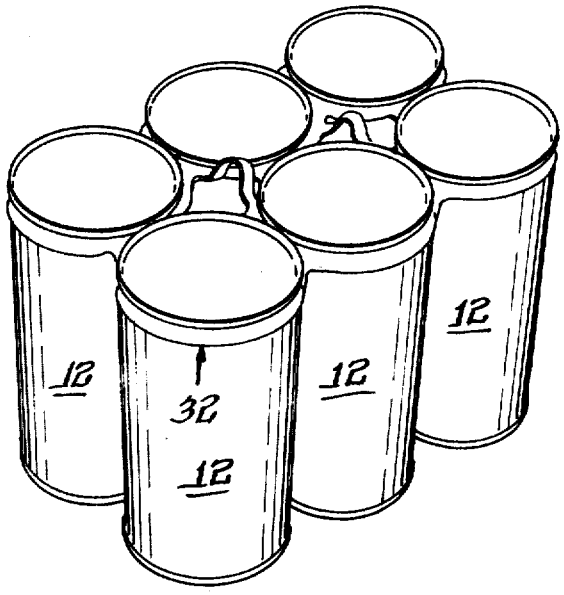
FIG. 3 is an isometric view of a multipackage of containers, such as produced by a practice of the invention.

At certain positions longitudinally of the strip 20, strap elements 30 and 31 integrally interconnected across a pair of straight-line band segments 23 and 24 as shown in FIG. 4 are provided as handle elements for the multipackage of containers 12. In FIG. 4 it may be seen that if the strip 20 is transversely severed through the webs 26 and 27 and the intersection area 25 therebetween at positions longitudinally of the strip 20 which are midway between the strap elements 30 and 31, individual carriers will be formed for twelve cans 12. It may be seen that with other locations of the strap elements 30 and 31 and with appropriate transverse severance of such strips, multipackages of other than twelve cans 12 may be produced. FIG. 3 shows such a modified strip 32 on six cans 12 to produce a multipackage of six containers. If a strip such as strip 20 is made without any strap elements 30 and 31, the strip may be transversely severed to produce 3-packs.

The multipackaging strip 20 is conveniently supplied to the machine from a reel 33 upon which the strip 20 has been wound after being made. The reel 33 is rotatively supported on a stand 34 on one side of the machine. From the reel 33 the strip 20 is extended over a supporting idler roller 35 mounted on the machine. From the idler roller 35 the strip 20 is carried under another idler roller 36 and from that roller the strip 20 passes about a powered feed roll 37. The powered feed roll may be of any type known in the art which automatically senses the load of the strip loop therebelow and draws additional strip 20 from the reel 33 as needed to maintain the depending loop. From the powered feed roll 37 the strip 20 passes into a guide system 38. The guide system 38 is substantially shown in enlarged plan view in FIG. 6 and is conveniently mounted between the side frame members 40 of the machine by rods such as rod 41 of FIG. 6.

Figure 5:
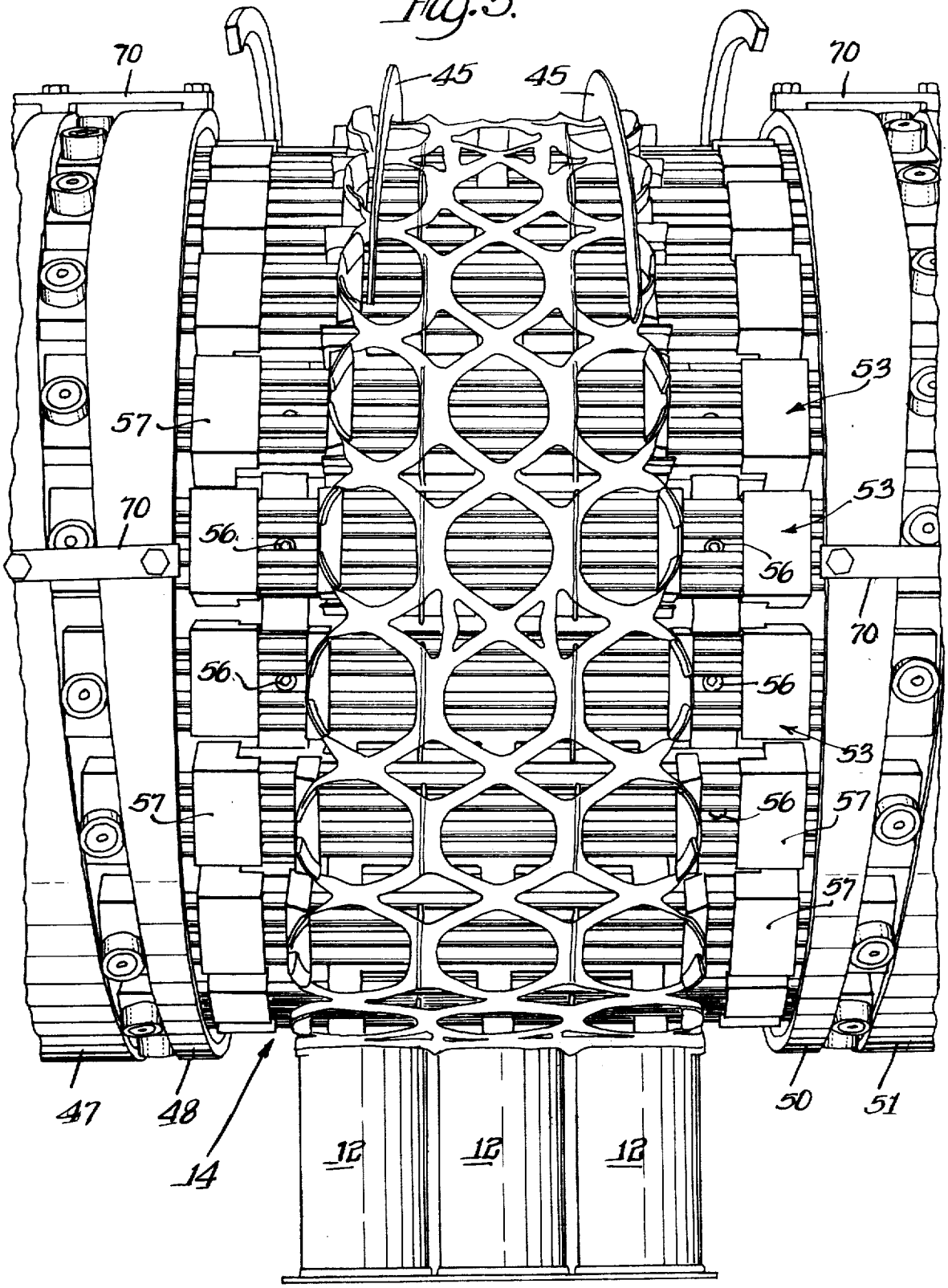
FIG. 5 is an enlarged side elevational view of the drum mechanism of the machine of FIGS. 1 and 2 and taken substantially along a line such as 5—5 of FIG. 1.
Figure 6:
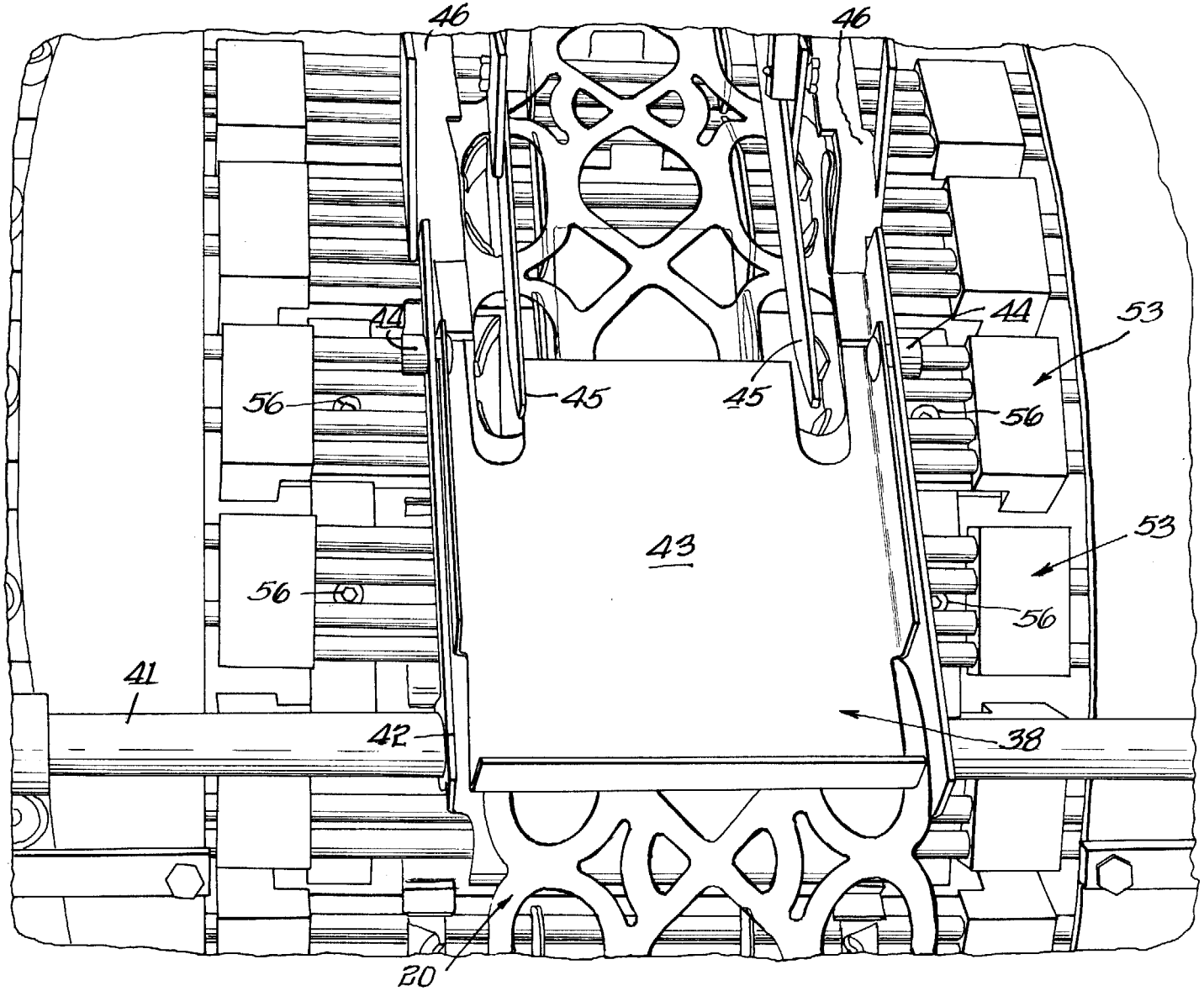
FIG. 6 is an enlarged elevational view of another portion of the drum assembly of FIGS. 1 and 2 and taken substantially along the line 6—6 of FIG. 1.

The guide assembly 38 as shown in FIG. 6 comprises a shallow U-shaped trough 42 which supports the flat strip 20 as it is moved into cooperation with the drum assembly 14. A hold-down plate 43 is carried in the trough 42 and lays on top of the strip 20 and creates a slight drag thereon. The upper end of the hold-down plate 43 is pivotally connected to the upstanding side walls of the trough 42 by pivotal mounting means 44. The guide assembly 38 further includes a pair of curved vertically aligned plates 45. The rearward ends of the plate 45 are shown in FIG. 6 and the forward ends thereof are shown in FIG. 5. The plates 45 are positioned immediately above and at transverse positions substantially longitudinally bisecting the side bands 21 and 22 to hold the strip 20 down as it enters onto the jaw stations of the jaw drum 14. The guide system 38 further includes forward extensions 46 on the trough 42. The forward extensions 46 each comprise a fixed pair of narrow elongated plates which are spaced-apart a distance slightly more than the thickness of the strip 20. The rearward ends of the extensions 46 are in planar alignment with the trough 42 to receive the outer band portions of the side or outboard bands 21 and 22 therebetween. From the rearward to the forward ends of the extensions 46 they are twisted about their longitudinal axes through an angle of substantially 90° to turn up the outer band portions of the side bands 21 and 22 as the bands move onto the jaws of the jaw stations of the drum assembly 14. As the upwardly bent outer band portions of the strip 20 are received upon the jaws of the drum assembly 14, the annular cam members 47, 48, 50 and 51 shown in FIG. 5 begin to spread the jaws transversely apart to firmly hold the strip 20 as it leaves the guide system 38.

The drum assembly 14 comprises two spider wheels (not shown) which are rotatively supported in a transversely spaced-apart relationship on a horizontal shaft 52 which in turn is rotatively carried between the upstanding frame members 40. Each jaw station 53 shown in detail in FIGS. 8 – 10 includes a mounting plate 54.

Figures 8, 9, 10, 11, 12:
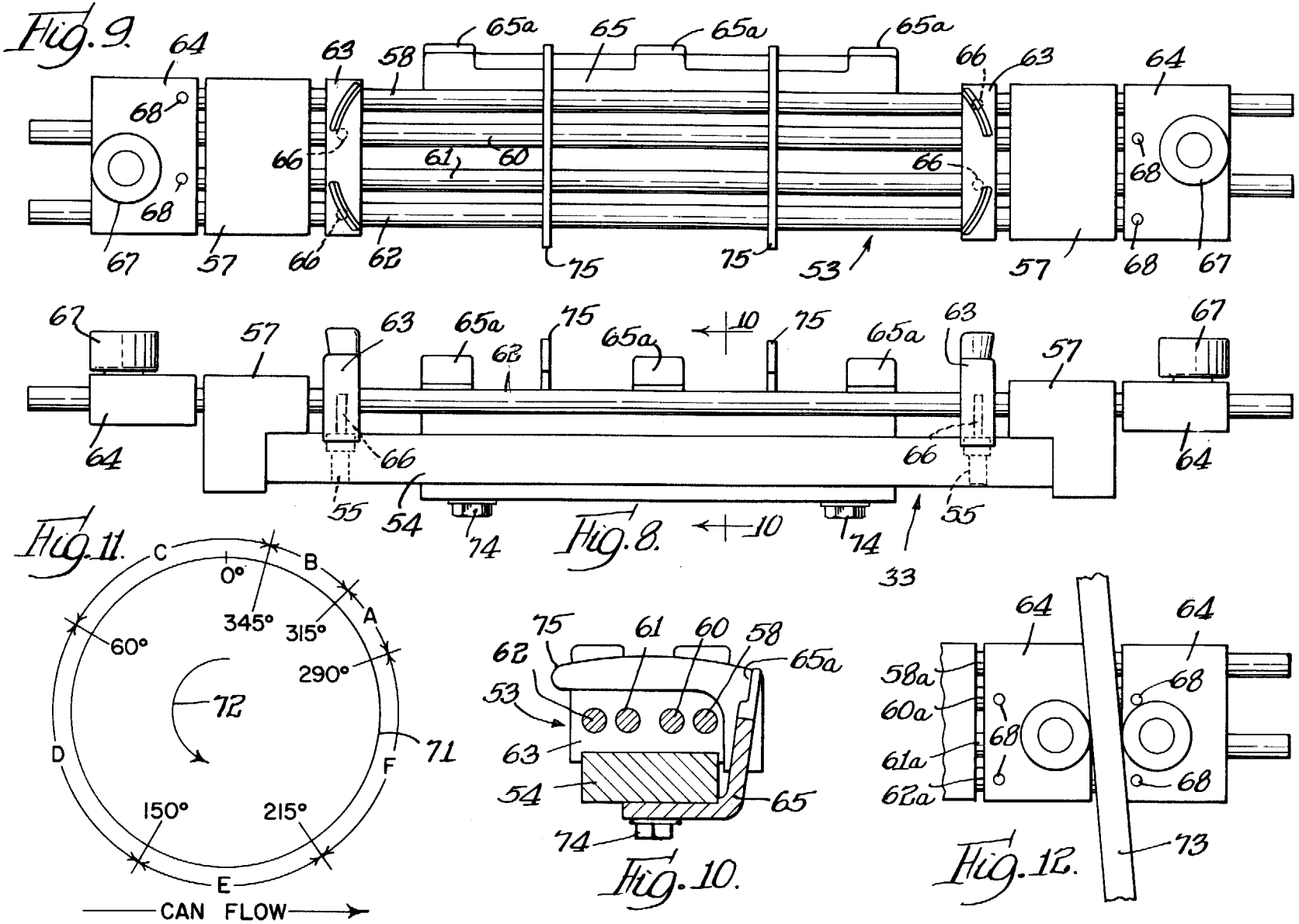
FIG. 8 is an enlarged side elevational view of one of the jaw stations of FIGS. 5, 6 and 7 removed from the drum assembly.
FIG. 9 is a top plan view of the jaw station shown in FIG. 8.
FIG. 10 is a cross-sectional view of the structure shown in FIG. 8 and taken substantially along the line 10—10 of FIG. 8.
FIG. 11 is a chart showing the operated positions of the jaw stations at various positions circumferentially of the drum assembly.
FIG. 12 is a top plan view of one end of a modified jaw station showing an alternative form of cam assembly for operating the jaw stations.

Each mounting plate 54 has a pair of holes 55 therethrough as shown in FIG. 8. Fasteners 56 shown in FIGS. 5 and 6 are projected through the openings 55 in the mounting plates 54 and threaded into the peripheries or rims of the spider wheels to support all of the jaw stations 53 in a cylindrical configuration about the axis of the shaft 52 with the longitudinal axes of the jaw stations 53 being parallel to the axis of the shaft 52. The circumferential spacing between jaw stations 53 is substantially equal or slightly less than the longitudinal center-to-center distance between the bands of the strip 20.

Each jaw station 53 includes, in addition to the mounting plate 54, a pair of supporting blocks 57, four rods 58, 60, 61 and 62, a pair of jaw elements 63, a pair of cam roller assemblies 64, and a strip tucker assembly 65. The supporting blocks 57 are secured on each end of the mounting plate 54 and each supporting block 57 is provided with four holes therethrough for the rods 58, 60, 61 and 62. The four rods 58, 60, 61 and 62 are journaled through the supporting blocks 57 in a parallel spaced-apart relationship as shown in FIGS. 8 – 10. The jaw assemblies 63 have four holes through the base portion thereof, as may be seen in FIG. 10, and the jaw assemblies 63 are journaled on the rods 58, 60, 61 and 62 between the supporting blocks 57. Each jaw assembly 63 of a jaw station 53 is fixed to two of the four rods 58, 60, 61 and 62 by a pin or other fastener 66 preferably inserted from the underside of the jaw assembly 63. As may be seen in FIG. 9, the jaw assembly 63 at the left side of the drawing is secured to rods 60 and 62, while the jaw assembly 63 at the right of the drawing is secured to rods 58 and 61. Thus, it may be seen that as the rods are longitudinally slid through the supporting blocks 57, the jaw assemblies 63 secured thereto will be carried thereby. As shown in FIGS. 8 and 9, the rods 58, 60, 61 and 62 are longitudinally positioned at what can be called the maximum open position for the jaw assemblies 63, and any strip 20 mounted thereon would be stretched to a maximum in its transverse direction. The outer band portions of the side bands 20 and 21 are carried on the two curved jaw segments extending upwardly from the upper end of the jaw assemblies 63. The radius of curvature of those jaw segments is preferably not less than the radius of curvature of the containers 12, but may be greater than the radius of curvature of the cans 12 under some conditions.

Figure 7:
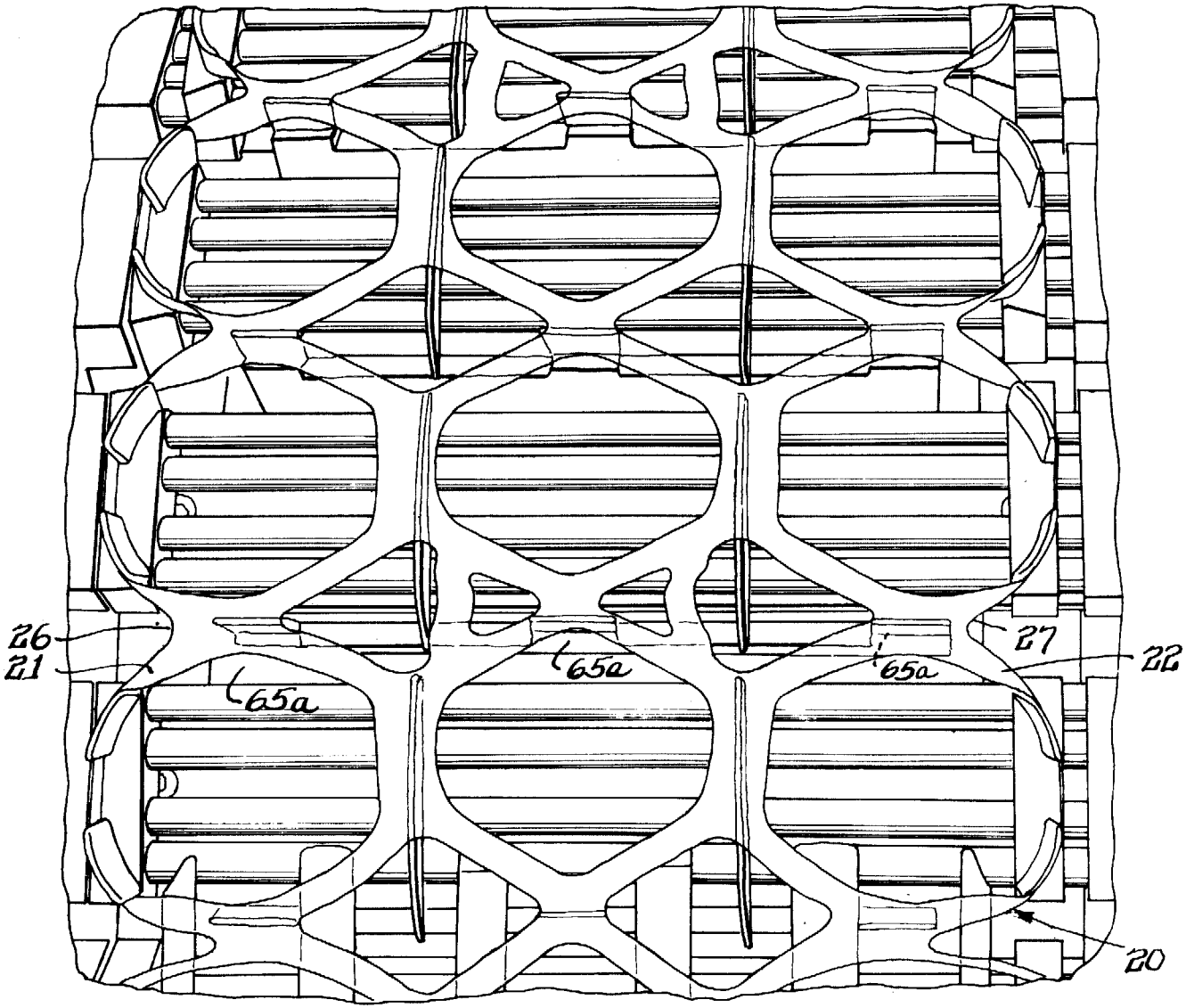
FIG. 7 is an enlarged bottom view of the drum assembly of FIGS. 1 and 2 and taken substantially along the line 7—7 of FIG. 1.

The rods 58, 60, 61 and 62 are caused to longitudinally reciprocate by the cam roller assemblies 64. Each cam roller assembly 64 comprises a block having four holes therethrough to receive the end portions of the rods 58, 60, 61 and 62, and a roller assembly 67 rotatively carried on the upper side of the block. The cam roller assembly 64 shown in the left side of FIGS. 8 and 9 is pinned or otherwise fastened to rods 58 and 61 by pins 68, and cam roller assembly 64 in the right side of FIGS. 8 and 9 is pinned or otherwise secured to rods 60 and 62 by pins or fasteners 68. Thus, it may be seen in FIGS. 8 and 9 that if the cam rollers 67 are moved apart, the jaw assemblies 63 will be moved toward each other as the rods slide in the blocks 57 and carry the jaw elements 63 which are secured thereto as noted above. FIG. 5 shows one arrangement for moving the cam roller assemblies 64 toward and away from each other as the drum assembly 14 rotates. That arrangement comprises a pair of annular members 47 and 48 for one side of the drum assembly and another pair of annular members 50 and 51 for the other side of the drum assembly. The annular members 47 and 48 are axially spaced-apart a distance slightly greater than the diameter of the cam rollers 67 and are secured to one of the frame members 40 and concentrically about the axis of the shaft 52 by a number of bracket and fastener assemblies 70. In a like manner, the annular members 50 and 51 are secured to the other frame member 40. The space between the members 47 and 48 and between the members 50 and 51 defines a cam track for the cam rollers 67. Alternatively, the members 47, 48, 50 and 51 may be made of a smaller diameter than the circles traced by the jaw stations 53 in rotating, and the cam rollers 67 may be mounted on the underside of jaw stations 53. The chart in FIG. 11 shows how the cam tracks are circumferentially shaped to open and close each of the jaw assemblies 63 of each of the jaw stations 53 circumferentially of the drum assembly 14. The camming action on the jaw assemblies 63 is shown by the circle 71. As shown the drum assembly 14 is rotated in the direction of the arrow 72 with the can flow being in the direction indicated so that the view in FIG. 11 is taken from the side of the machine shown in FIG. 1. With zero degrees being shown at the top dead center of the chart, the various camming actions of the members 47, 48, 50 and 51 producing a complete cycle are shown by the six arcuate sections of the circle "A" through "F". Arcuate section A from about 290° to 315° is the section where, as shown in FIG. 6, the jaw assemblies 63 of successive jaw stations 53 are receiving the strip 20 near the upper end of the hold-down plate 43 in FIG. 6. During that arcuate section of rotation of the jaw stations 53, the jaw assemblies 63 are closed or at their position of closest spacing between each other. During arcuate section B from about 315° to 345°, the jaw assemblies 63 are partially opened against the folded outer band portions of the side bands 21 and 22 to firmly hold the strip with no appreciable transverse stretching. That area is not shown in the drawings, but would be above the view in FIG. 6. Arcuate section C extends from about 345° before top center to 60° thereafter. That section is shown in the upper quarter of FIG. 5 and during the period of passage of the jaw stations 53 through that section there is substantially no relative movement of the jaw assemblies 63 with the cam profile of the members 47, 48, 50 and 51 being in a dwell period. Arcuate section D, which extends from about 60° to 150° is substantially completely shown in FIG. 5 and during the period of passage of the jaw stations 53 through that section the successive jaw assemblies 63 are gradually moved to the full open position. The full open position is reached at about 150°, and from 150° to 215° the cam profile of the members 47, 48, 50 and 51 is in a dwell situation. That section is shown as arcuate section E in FIG. 11, and about half of that section is shown in FIG. 7. The showing in FIG. 7 would be from about 180°. During the period of passage of the jaw stations 53 through that section the arcuate sections of the jaw assemblies 63 are moved below the upper margin of the cans 12 to apply the bands of the strip 20 about the cans 12. From about 180° to about 215°, the multipackaged containers 12 are leaving the work station along the line of can flow and the relative upward movement of the jaw stations 53 caused by the rotation of the drum assembly 14 draws the arcuate sections of the jaw assemblies 63 from the applied strip 20. The last arcuate section, section F, extends from about 215° to 290°, and during the period of passage of the jaw stations 53 through that section, the cam profile of the members 47, 48, 50 and 51 causes the jaw assemblies 63 to return to the closed position preparatory to again receiving the strip 20. It should be understood that the chart of FIG. 11 is exemplary of one cam profile and that portions of the profile can be changed within the defined scope of operation. FIGS. 5 and 7 are intended to show the configuration that the strip 20 assumes as it is being stretched by the jaw assemblies 63 of the jaw stations 53 as the drum assembly 14 rotates. Reductions to practice of the invention have established that the final configurations shown in FIG. 7 substantially approximate the circular configuration of the cans 12 to the extent that the bands of the strip are easily projected downwardly over the cans 12 to apply the bands about the cans.

FIG. 12 shows a modified construction for the jaw stations 53 and the annular cam members 47, 48, 50 and 51. In the modified form, the rods 58*a*, 60*a*, 61*a* and 62*a* are longer than those rods as above described without the suffix "*a*" and are provided with two cam roller assemblies 64 at each end thereof rather than a single cam roller assembly 64 as above described. Each pair of cam roller assemblies 64 is secured by pins or fasteners 68 to the rods at the end portions thereof and are spaced-apart a distance substantially equal to the thickness of the member 73. The member 73 is an annular ring that is substituted in place of the annular cam members 47, 48, 50 and 51 and is mounted in a manner similar to the arrangement for those annular members. The rings 73 are bent to produce the same cam profile as that of the members 47, 48, 50 and 51.

One arrangement for aiding in the application of the strip 20 to the cans 12 is the strip tucker assembly 65 which is mounted on each of the jaw stations 53. The assembly 65 is formed as a somewhat L-shaped member as may be seen in FIG. 10. The base of the assembly 65 is secured to the underside of the mounting plate 54 by fasteners 74 with the other portion of the assembly 65 extending upwardly along one side of the jaw station 53. The extending upper end of the assembly 65 is provided with three projections 65*a*. Each projection 65a is positioned longitudinally of the jaw station 53 at a position substantially midway of the area transversely spanned by one of the bands of the strip 20 in the fully stretched condition. FIG. 7 shows the longitudinal disposition of the three projections 65*a*. In a direction transversely of the jaw stations 53, the projections 65*a* are aligned to lie substantially on a line drawn between the webs 26 and 27 of the bands 21 and 22 of the strip 20, or substantially midway between adjacent jaw stations 53. The height of the projections 65*a* is substantially on or slightly above a line drawn between the upper ends of the base portions of the jaw assemblies 63 of each jaw station 53. In the operation of the machine of the subject invention, the projections 65*a* operate as backup or tucking members for the web portions of the strip 20 between adjacent bands thereof in a longitudinal direction of the strip 20.

The assembly 65 of each jaw station 53 further includes two upright plates 75. Each plate 75 is somewhat L-shaped with one leg thereof secured to the upstanding portion of the assembly 65 and with the other leg thereof extending horizontally across and above the rods 58, 60, 61 and 62. In the longitudinal direction of the jaw stations 53, each plate 75 is substantially midway between two adjacent projections 65a. The upper edge of the horizontal leg of each plate 75 may be curved as shown in FIG. 10. The plates 75 extend upwardly above the projections 65*a*, but below a line drawn between the upper edges of the band holding portions of the jaw assemblies 63 of each jaw station 53. Thus, the upper edges of plates 75 are within the planar area of the strip 20 on the jaw assemblies 63. In operation, the plates 75 operate as tucking members to insure that the web portions between the bands of transversely adjacent bands of the strip 20 are tucked between the cans 12 in a direction longitudinally of the strip 20 contemporaneously with the application of the strip 20 to the cans 12.

Appropriately driven known gearing mechanisms may be used to rotate the drum assembly 14 and to operate the input conveyor 11 and the output conveyor 15 in timed relationship so that the cans 12 successively pass beneath the drum assembly 14 concentrically within successive stretched bands of the strip 20 on the underside of the drum assembly 14 as the drum assembly 14 rotates.

Appropriate known mechanisms may be provided over the output conveyor 15 to transversely sever the applied strip 20 between selected cans 12 to produce individual packages of selected multiples of three cans 12.

From the foregoing description of the subject invention, it will be understood that the drum assembly may be made with jaw stations 53 that are longer than the jaw stations as described and with additional projections 65*a* and plates 75 to handle strips which are more than three bands wide. Of course, in such wider arrangements the strip must be made so that all of the bands transversely thereacross will stretch into appropriate container applying configurations upon the transverse spreading of each pair of jaws 63 of each jaw station 53.

Having described the invention, it is to be understood that changes can be made in the defined embodiments by one skilled in the art within the spirit and scope of the present invention as defined in the hereinafter following claims.

We claim:

1. In combination, a resilient, stretchable plastic material strip comprising at least three rows of bands with said bands elongated in the longitudinal direction of said rows, web means integrally interconnecting said bands longitudinally in said rows and transversely between said rows, the shape of said bands and the interconnections of said web means between said bands producing bands apertures substantially complementary to the circumferential configuration of certain containers responsive to the application of transversely opposed stretching forces of a certain amount solely to the side marginal portions of said strip, a work station, means moving at least three adjacent rows of said certain containers through said work station, a series of pairs of opposed longitudinally arranged stretching members, means for applying the side marginal portions of said strip onto said series of pairs of opposed stretching members, means for moving said series of pairs of opposed stretching members to apply opposed stretching forces of said certain amount to said side marginal portions of said strip and means for successively moving said series of pairs of opposed stretching members with said strip applied thereon and stretched said certain amount into said work station and in a direction relatively toward said moving rows of said certain containers to circumferentially apply said bands successively about said certain containers.

2. In a combination as defined in claim 1, and means in said work station for relatively moving said series of pairs of opposed stretching members away from said moving rows of certain containers after application of said bands of said strip circumferentially about said certain containers to successively separate said series of pairs of opposed stretching members from said applied strip.

3. A packaging system for multipackaging three substantially adjacent rows of containers into packages of a selected number of containers in multiples of three containers, comprising the steps of:

providing a carrier strip from a resilient elastic plastics-material with the strip being substantially narrower than the width of the three rows of adjacently positioned containers with which said strip is to be associated and comprising three rows of bands having apertures which are substantially elongated longitudinally of said strip and with said three rows of bands being integrally interconnected transversely and longitudinally of said strip to stretch said apertures into substantially complementary shapes to those of said containers when the inner margins of the outboard band portions of the transversely outward bands are moved transversely apart a distance at least as great as the width of said three rows of substantially adjacently positioned containers, moving said three rows of substantially adjacently positioned containers continuously in a substantially straight-line through a work station, applying a series of pairs of force applicating elements which are spaced-apart a distance less than the width of said strip successively within the outboard apertures of said strip, thereafter successively moving said force applicating elements apart to transversely stretch each transverse series of three bands in said three rows of bands, successively moving said force applicating elements into said work station toward the tops of said three rows of moving containers, while continuing to successively move said pairs of force applicating elements apart, thereafter successively moving said force applicating elements relatively toward and downwardly over the tops of said three rows of moving containers when said force applicating elements are moved apart sufficiently to clear the outboard containers in said three rows of substantially adjacently positioned containers, thereafter successively moving said force applicating elements relatively upwardly from the tops of said three rows of adjacently positioned containers while continuing the straight-line movement of said three rows of adjacently positioned containers to successively withdraw said force applicating elements from said applied strip, and thereafter severing said strip between selected longitudinally adjacent bands to form packages of a selected number of containers in multiples of three containers.

4. A packaging system for multipackaging at least three substantially adjacent rows of generally cylindrical containers into packages of a selected number of containers in multiples of the number of rows of said containers, comprising the steps of:

providing a carrier stock from a strip of resilient, flexible elastic plastic sheet material with the strip being substantially narrower than the width of the rows of containers with which they are to be associated and comprising rows of bands equal in number to said rows of containers and having apertures which are substantially elongated longitudinally of said strip and with said rows of bands being integrally interconnected transversely and longitudinally of said strip to stretch all of the apertures of said bands into shapes having a length and width approximating the outer diameter of said containers when the inner sides of the transversely outward band portions of the bands along the sides of said strip are moved transversely apart a distance at least as great as the width of said rows of containers, moving said at least three rows of substantially adjacent containers continuously in a substantially straight line through a work station, inserting a longitudinally arranged series of pairs of jaws which are spaced-apart a distance less than the width of said strip successively within the apertures of the bands along the opposite sides of said strip, successively moving said inserted pairs of jaws apart to transversely stretch all of the bands in each of said rows of bands, thereafter successively moving said pairs of jaws into the vicinity of said work station and toward the tops of said rows of moving containers while continuing to move said pairs of jaws apart, successively moving said pairs of jaws in superposing fashion relative to the tops of said rows of moving containers when said pairs of jaws are moved apart sufficiently to clear the containers in the outer side rows of containers and to successively apply the bands of said strip to said rows of containers, thereafter successively moving said pairs of jaws relatively upwardly from the tops of said rows of containers while continuing the straight-line movement of said rows of containers to continuously draw said successively upwardly moving pairs of jaws from engagement with said applied strip, and thereafter severing said strip between selected longitudinally adjacent bands to form packages of a selected number of containers in multiples of the number of rows of said containers.

5. A method for assembling a plurality of containers continuously moving through a work station in a column at least three abreast with a resilient plastic carrier strip in which the carrier strip comprises transversely and longitudinally interconnected bands of at least three in number transversely of the strip and with the bands of the strip in its initial condition defining apertures having major and minor axes with the substantially longer major axes disposed in the longitudinal direction of said strip and with the minor axes disposed in the transverse direction, comprising the steps of:

serially applying opposed holding forces on the inward sides of the transversely outward ones of said bands of said strip, thereafter successively increasing said opposed holding forces to successively stretch said strip transversely to a point at which each of said at least three bands approximates the outer transverse dimension of said containers in said column, contemporaneously successively moving each of said at least three bands of said strip relative to each of said at least three abreast containers moving through said work station to successively slip each of said at least three bands of said strip which approximates the outer transverse dimension of said containers over one end and about the outer surface of each of said at least three abreast containers in said work station, continuing to move said containers mounted by said bands from said work station, and thereafter successively removing said opposed holding forces from said bands.

6. In a method as defined in claim 5, wherein said carrier bands are flat planar bands of substantially greater width than thickness, the additional step of folding the outward side portions of the transversely outward ones of said bands of said strip to approximately a right angle to the plane of said bands before said first step of serially applying opposed holding forces on the inward sides of the transversely outward ones of said bands of said strip.

7. In a machine for multipackaging at least three substantially adjacent rows of containers with a resilient, flexible plastic material strip of at least three adjacent rows of bands for encircling said containers wherein the width of said strip is substantially less than the width of said at least three adjacent rows of containers, said machine having an input conveyor including means delivering at least three adjacent rows of containers through a work station, and an output conveyor conveying multipackaged containers from said work station, and further having an applicating drum assembly mounted at said work station for rotation about a horizontal axis perpendicular to and above the line of movement of said containers through said work station, the improvement of said drum assembly comprising a plurality of jaw stations mounted on said drum assembly circumferentially thereabout, each of said jaw stations comprising a single pair of jaws mounted thereon for reciprocation toward and away from each other along an axis substantially parallel to the axis of rotation of said drum assembly and extending radially from said drum assembly a distance sufficient to pass below the top surfaces of said containers, moving through said work station as said drum assembly is rotated, means for successively reciprocating each of said pair of jaws from a strip receiving position with a spacing between the jaws less than the width of said at least three adjacent rows of containers to a strip applying position with a spacing between the jaws more than the width of said at least three rows of containers, means for directing said strip successively over said pairs of jaws at said strip receiving position with said pairs of jaws extending through the apertures of the bands along the sides of said strip, and said means for successively reciprocating each of said pair of jaws arranged in said work station to serially bring said pairs of jaws at said strip applying position into an applicating relationship with the bands of said strip over said at least three rows of containers.

8. In a machine for multipackaging three substantially adjacent rows of containers with a resilient plastics-material strip of three adjacent interconnected rows of bands for encircling said containers wherein the width of said strip is substantially less than the width of said three adjacent rows of containers, said machine having an input conveyor including means delivering three adjacent rows of containers through a work station, and an output conveyor conveying multipackaged containers from said work station and further having an applicating drum assembly mounted at said work station for rotation about a substantially horizontal axis perpendicular to and above the line of movement of said containers through said work station, the improvement of said drum assembly comprising a plurality of jaw stations mounted on said drum assembly circumferentially thereabout, each of said jaw stations comprising a single pair of jaws mounted thereon for reciprocation toward and away from each other along an axis substantially parallel to the axis of rotation of said drum assembly and extending radially from said drum assembly a distance sufficient to pass below the top surfaces of said containers moving through said work station as said drum assembly is rotated, a strip guide assembly mounted in said machine in cooperation with said drum assembly to receive and direct said strip of three adjacent rows of bands substantially tangentially of said drum assembly, cam means mounted in said machine in cooperation with said jaw stations for reciprocating each of said single pair of jaws toward and away from each other responsive to the rotation of said drum assembly, said cam means being formed to move each of said single pair of jaws prior to the tangential reception of said strip from said guide assembly to a spacing therebetween less than the width of said three adjacent rows of containers and less than the spacing between the inner margins of the transversely outward band portions of the bands along the sides of said strip to permit each of the bands along the sides of said strip to be received about one of said jaws of each of said single pairs of jaws with the central bands of said strip between each of said single pairs of jaws, and said cam means being further formed to move each of said single pair of jaws prior to said jaws passing below the top surfaces of said containers to transversely stretch the bands along the sides of said strip and the central bands of said strip and to a maximum spacing between each of said single pair of jaws greater than the width of said three adjacent rows of containers.

9. In a machine as defined in claim 8, and each of said jaw stations further including a pair of plates, means fixedly mounting said pair of plates in each jaw station perpendicular to the axis of reciprocation of each of said single pairs of jaws and extending in a radial direction of said drum assembly to an extent substantially coinciding with a plane through the strip carrying portions of said jaws, and said pair of plates being further fixedly mounted between said single pair of jaws at positions of substantially one third of the maximum spacing between each of said single pair of jaws.

* * * * *